US005441213A

United States Patent [19]

Graham

[11] Patent Number: 5,441,213

[45] Date of Patent: Aug. 15, 1995

[54] DIAMETER FEEDBACK CONTROLLED WINDING DEVICE

[75] Inventor: Walker O. Graham, Waterloo, S.C.

[73] Assignee: Cooper Machinery, Inc., Fountain Inn, S.C.

[21] Appl. No.: 114,583

[22] Filed: Aug. 31, 1993

[51] Int. Cl.[6] ..... B65H 18/20

[52] U.S. Cl. ..... 242/534.2; 242/542.2; 242/563.2

[58] Field of Search ..... 242/542.2, 534.2, 390.1, 242/563.2, 542

[56] References Cited

U.S. PATENT DOCUMENTS 1,455,976 5/1923 Stevens ..... 242/542.2 X
2,581,711 1/1952 Roselius ..... 242/542.2 X
4,171,106 10/1979 Crouse ..... 242/542.2 X
4,223,850 9/1980 Alexander, III ..... 242/542.2
4,657,198 4/1987 Shimizu et al. ..... 242/534.2 X
4,893,763 1/1990 Wales et al. ..... 242/534.2 X

*Primary Examiner*—John Q. Nguyen
*Attorney, Agent, or Firm*—Dority & Manning

[57] ABSTRACT

A surface drive winding apparatus for winding a material into a roll including a frame for supporting a plurality of drive rollers and a plurality of drive rollers in substantially parallel orientation and forming a material roll receiving area therebetween. At least one of the drive rollers is linearly movable away from the other drive roller responsive to changes in the diameter of the material roll as it is wound. A proximity sensing is disposed above the rollers at a position such that a vertical plane through the longitudinal centerline of the material roll moves towards the sensing device as the material roll grows in diameter.

14 Claims, 5 Drawing Sheets

DIAMETER FEEDBACK CONTROLLED WINDING DEVICE

BACKGROUND OF THE INVENTION

The present invention relates generally to winding devices and more particularly to an improved surface drive winding apparatus with at least one of the surface drive rollers being movable responsive to changes in the diameter of the material roll being wound.

It is well known to use surface contact as the driving force for winding and unwinding rolls of material such as textile fabrics and the like. It is also known to adjust the relationship of the drive rolls with respect to each other depending on the size of a particular roll of material being wound. However, such movement of the drive rollers with respect to each other has not been continuously accomplished proportionate to the actual changes occurring in the size of a roll as it is wound. In prior art devices, any changes in the relative position of the drive rollers are accomplished intermittently and not continuously and proportionately to the changing diameter of the material roll. The prior art devices have the disadvantages of providing less uniform winding of the material roll as well as operating at lower speeds than the present invention.

Summary of the Invention

The present invention recognizes and addresses the foregoing disadvantages, and others of prior art constructions and methods.

Accordingly, it is an object of the present invention to provide an improved material roll winding device.

It is another object of the present invention to provide a material roll winding device that produces a more uniformly wound roll of material.

It is another object of the present invention to provide an improved surface driven take up device capable of increased operating speeds.

It is a further object of the present invention to provide an improved surface drive winding apparatus which includes continuous feedback and proportionate control of the distance between the drive rolls responsive to changes in the diameter of the material roll.

It is a further object of the present invention to provide an improved surface drive winding apparatus that maintains the position of the contact areas between the driving rolls and the material roll substantially unchanged as the material roll is wound.

These and other objects are accomplished by providing a surface drive winding apparatus for winding a material into a roll, the surface drive winding apparatus including a frame for supporting a plurality of drive rollers thereon, and a plurality of drive rollers supported on the frame in substantially parallel orientation and forming a material roll receiving area therebetween. At least one of the drive rollers is linearly movable away from the other drive roller. The surface drive winding apparatus further includes sensing means for sensing the diameter of the material roll and means for moving the at least one drive roller responsive to the diameter of the material roll sensed by the sensing means so that the at least one movable drive roller will be moved relative to the other drive roller responsive to changes in the diameter of the material roll as it is wound.

These and other objects are also accomplished by providing a surface drive winding apparatus for winding a material into a roll, the surface drive winding apparatus including a frame for supporting a plurality of drive rollers thereon, and a plurality of drive rollers supported on the frame in substantially parallel orientation and arranged so as to receive and drive a roll of material to be wound. One of the drive rollers is mounted for linear movement away from the other of the drive rollers. A stationary proximity sensor is provided for sensing the diameter of the material roll being wound above the material roll receiving area at a position displaced from a vertical plane through the longitudinal centerline of the receiving area when the movable roller is at its initial position such that the vertical plane moves toward said sensing device as the material roll grows in diameter during winding. A position sensor is provided for sensing the linear position of the drive roll. The surface drive winding apparatus further includes a comparator for comparing a signal indicative of the linear position of the movable drive roller to a predetermined value for a particular material roll diameter, and providing a signal to activate movement of the movable drive roller to substantially approximate a predetermined desired position for the movable drive roller for any given material roll diameter so that the movable drive roller is moved proportionally to the change in diameter of the material roll. The predetermined values are determined so that the position of the contact areas between the driving rolls and the material roll will remain substantially unchanged as the material roll is wound and the movable drive roll is moved.

Other objects, features and aspects of the present invention are discussed in greater detail below.

BRIEF DESCRIPTION OF THE DRAWINGS

A full and enabling disclosure of the present invention, including the best mode thereof, to one of ordinary skill in the art, is set forth more particularly in the remainder of the specification, including reference to the accompanying figures, in which.

Figure 1:
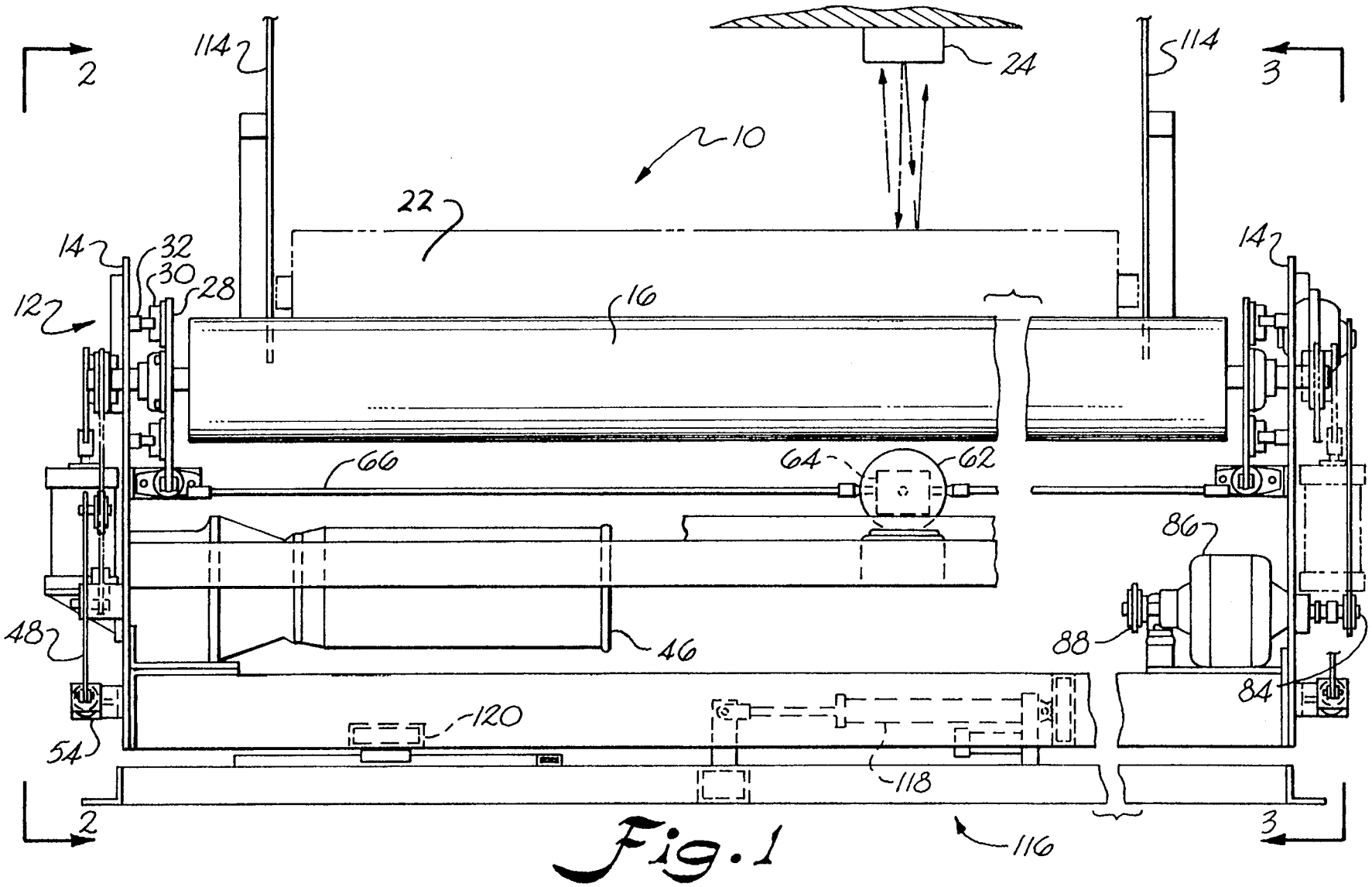
FIG. 1 is a front perspective view of a surface drive winding apparatus in accordance with an embodiment of the present invention.

Repeat use of reference characters in the present specification and drawings is intended to represent same or analogous features or elements of the invention.

DETAILED DESCRIPTION OF PREFERRED EMBODIMENTS

It is to be understood by one of ordinary skill in the art that the present discussion is a description of exemplary embodiments only, and is not intended as limiting the broader aspects of the present invention, which broader aspects are embodied in the exemplary construction.

Figure 2:
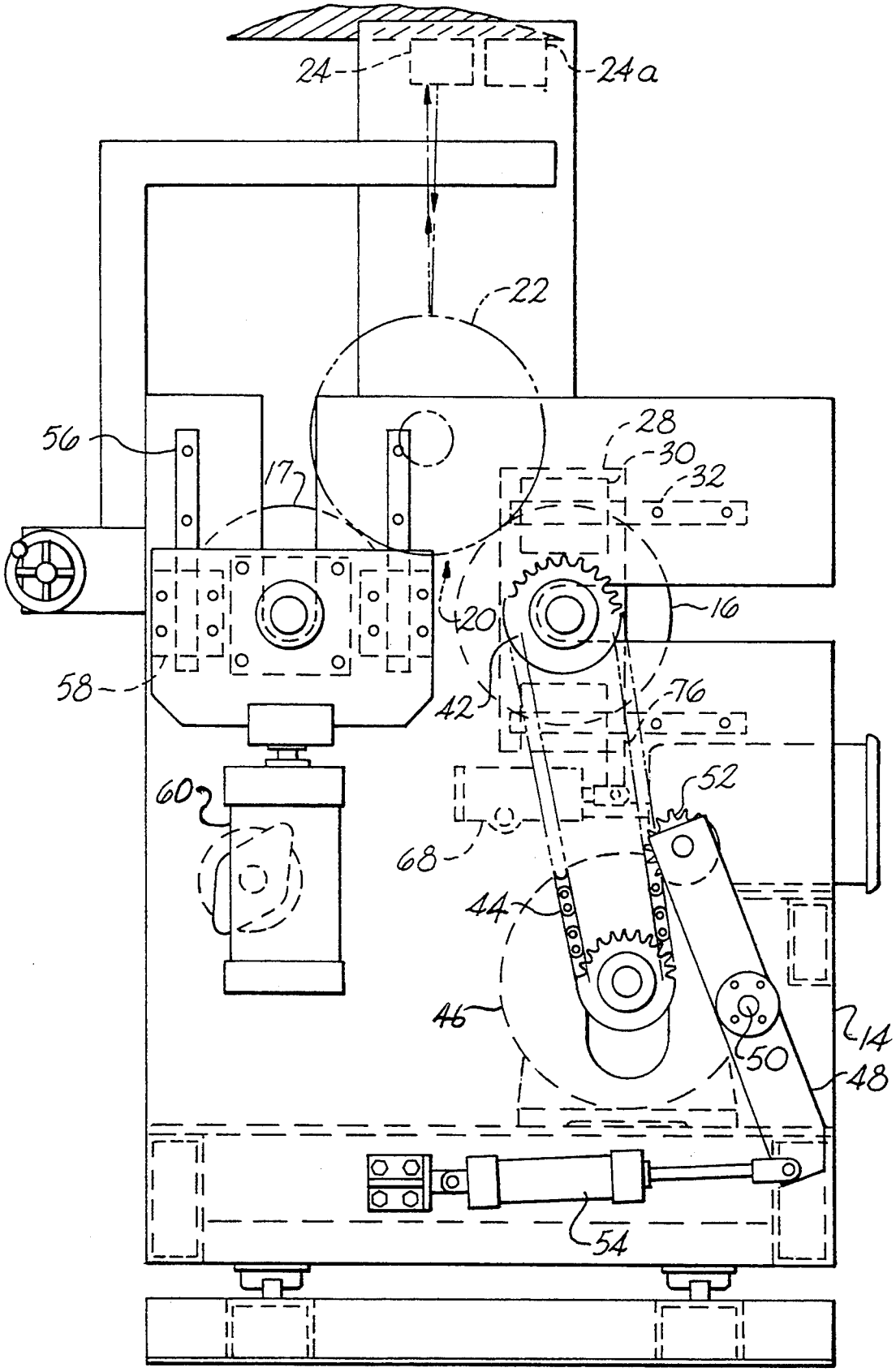
FIG. 2 and 2*a* are end views taken in the direction of lines 2—2 of FIG. 1 showing alternates embodiments.

Referring to FIG. 1, a surface drive winding apparatus in accordance with an embodiment of the present invention is generally illustrated at 10. The winding apparatus includes a frame 12 with end plates 14 that are adapted to support a plurality of drive rollers 16 and 17 (see particularly FIG. 2). Referring to FIGS. 1 and 2, drive rollers 16 and 17 are supported on frame 12 by end plates 14 in substantially parallel orientation to form a material roll receiving area 20 therebetween. Material roll receiving area 20 is adapted to receive a core or a web or material roll 22 for winding.

Figure 4:
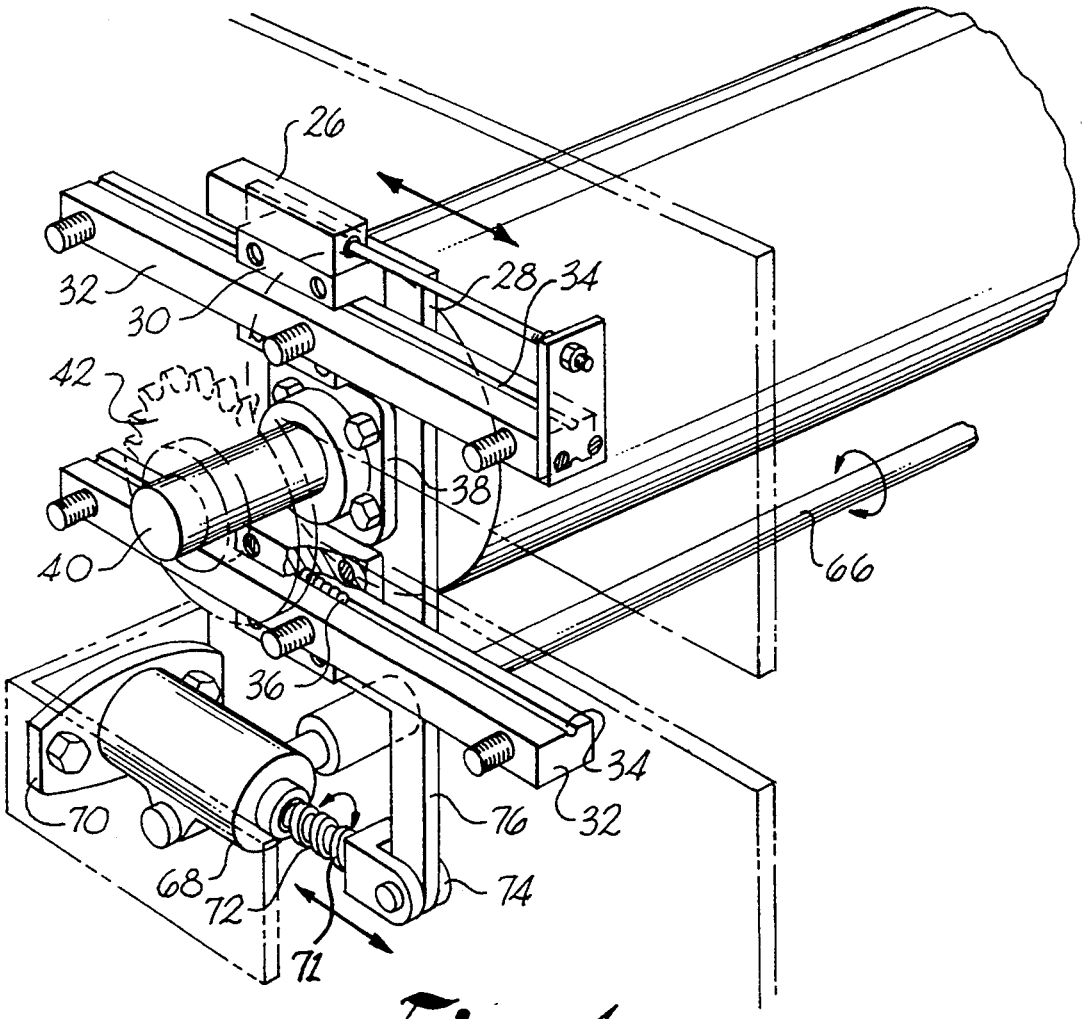
FIG. 4 is a detailed perspective view of a movable drive roll in accordance with an embodiment of the present invention.

As best illustrated in FIG. 2, drive roller 16 is adapted for linear movement away from drive roller 17 in response to the change in diameter of material roll 22 as it is wound. In general, a sensor 24 is adapted to sense the diameter of material roll 22. As best illustrated in FIG. 4, a position sensor 26 is provided for monitoring the linear position of drive roller 16 as it is moved. The signals from sensor 24 and sensor 26 are utilized to compare to a predetermined desired position for the drive roller 16 for a particular material roll diameter and to adjust the linear position of drive roller 16 to correspond to this predetermined desired position as will be explained in more detail below.

Referring to FIGS. 1, 2 and 4, a preferred embodiment of the present invention includes a mounting plate 28 secured to the shaft of drive roller 16 and having secured thereto a linear bearing block 30. Mounted to winder end plates 14 is a linear bearing rail 32 which includes a bearing receiving portion 34 for receipt of bearings 36. Linear block 30 rides on linear bearing rail 32 through bearings 36, which in a preferred embodiment may be ball bearings. Mounting plate 28 is secured to movable roller 16 through flange bearing 38 so that drive roller 16 may be driven to provide the drive for winding material roll 22, and further may be moved linearly with respect to roller 17 through the linear bearing arrangement set forth above. Drive roller 16 includes a shaft 40 that is adapted to receive a sprocket 42 in operative engagement therewith.

Referring to FIGS. 1 and 2, sprocket 42 engages a chain or other drive connection member 44 which is operatively connected to a roll drive motor 46 as is well known in the art.

To compensate for changes in the tension of chain 44 as drive roller 16 is linearly moved, a tension arm 48 is provided that pivots about pivot point 50 and includes tension sprocket 52 rotatably mounted with respect to tension arm 48 and adapted to engage a portion of chain 44. A tension cylinder 54 is provided to apply an appropriate amount of tension to tension arm 48 so that any slack in chain 44 that occurs as a result of drive roller 16 being linearly moved will be taken up so as to provide proper chain drive tension from roll drive motor 46 to drive roller 16.

Drive roller 17 may be mounted for vertical movement for the purpose of doffing, i.e. unloading, the material web after it is wound. If such feature is incorporated, it can be accomplished by use of linear bearing rails 56 and linear bearing blocks 58 that are mounted to drive roller 17 in a similar manner as described with respect to drive roller 16, but in a vertical orientation so that drive roller 17 may move up and down with respect to drive roller 16. For actuating such vertical movement, doffing cylinders 60 may be provided and actuated when it is desired to move drive roller 17 vertically for unloading material roll 22.

Referring now in more detail to the means for moving drive roller 16, with reference made particularly to FIGS. 1, 2, and 4, a drive motor 62 is connected through a right angle gear box 64 to a screw actuator power rod 66. It should be appreciated that drive roller 16 is moved linearly on both of its ends in the same manner and, therefore, the present description will be with reference to one side only of the moving arrangement. Description is with reference to the view along lines 2—2 in FIG. 1, but it should be appreciated and as is apparent from FIG. 3, the linear movement means on the opposite end of drive roller 16 is identical to that which will be described with respect to FIGS. 1, 2, and 4.

Screw actuator rod 66 is operatively connected to a screw actuator 68 which is fixedly mounted through mounting fixture 70 to a portion of frame 12. Screw actuator 68 may be a Duff Norton screw actuator and include an output shaft with acme screw threads such as illustrated at 72. Screw actuator shaft 72 of screw actuator 68 is connected through a pivotal fixture 74 to arm member 76 that is operatively connected to mounting plate 28 whereby rotation of screw actuator power rod 66 causes shaft 72 of screw actuator 68 to move arm member 76 linearly which, through its connection to mounting plate 28, causes drive roller 16 to move linearly along the tract formed by bearing rails 32. It should appreciated by one skilled in the art that the use of a single motor and right angle gear box provides to a great extent synchronous movement of both sides of drive roller 16 to maintain its parallel orientation with respect drive roller 17. While such is preferred, it is not essential to the present invention.

Figure 3:
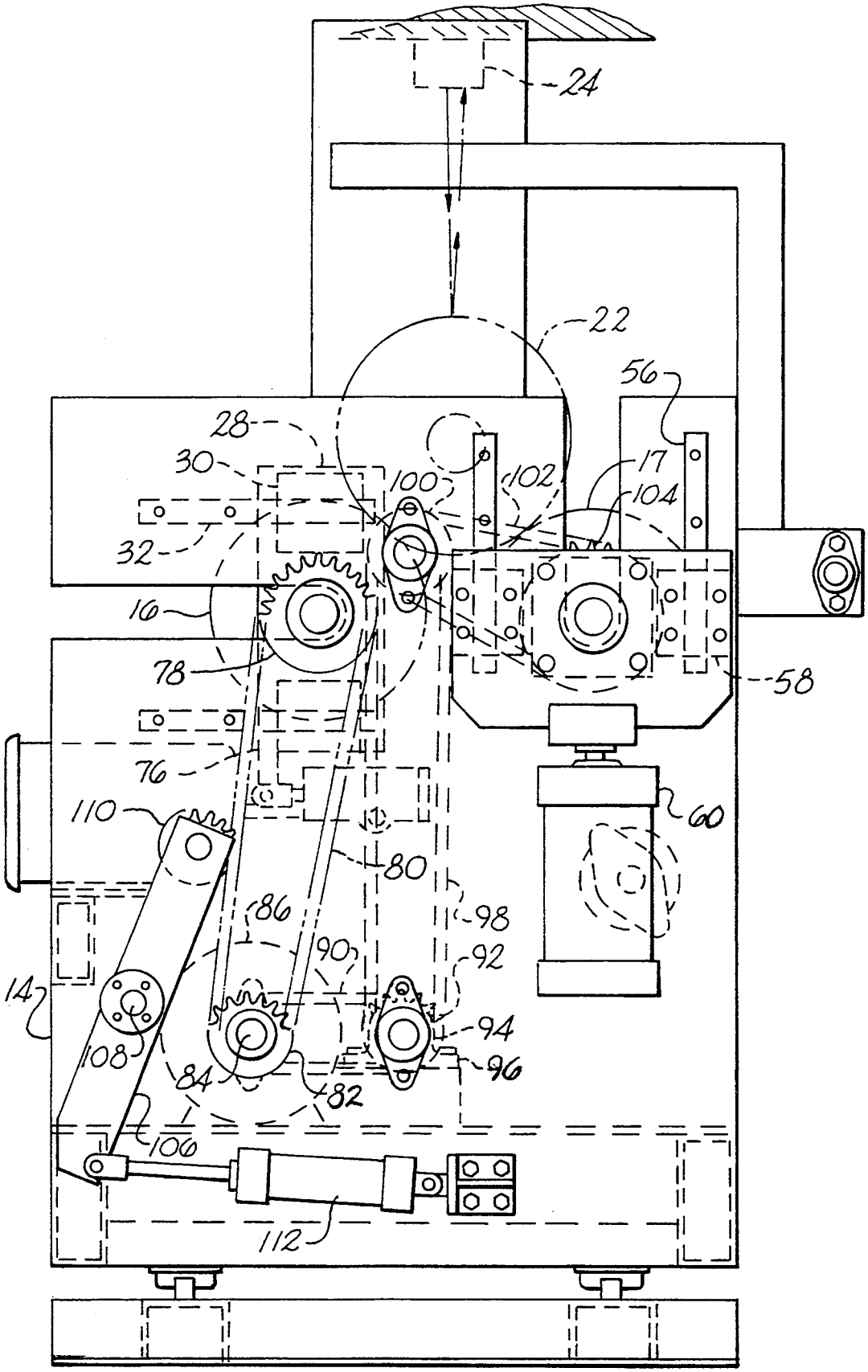
FIG. 3 is an end view taken along the lines 3—3 of FIG. 1.

Referring to FIGS. 1 and 3, the mechanism for driving drive roller 17 will be described. Drive roller 16 is driven by roll drive motor 46. On the opposite end of drive roller 16, a transfer sprocket 78 is attached to the shaft of drive roller 16 and rotates therewith. Transfer sprocket 78 is connected through a drive chain 80 to a first transfer sprocket 82 which is attached to the shaft 84 of a clutch unit 86. Clutch unit 86 includes a second transfer sprocket 88 attached on an output shaft of clutch unit 86, which is operatively connected through chain 90 to a third transfer sprocket 92. Third transfer sprocket is supported on a common shaft with a fourth transfer sprocket 94 in a pillow block bearing 96. Third and fourth transfer sprockets are connected for simultaneous rotation. Chain drive member 98 is connected between fourth transfer sprocket and a fifth transfer sprocket 100. Fifth transfer sprocket is connected through chain drive means 102 to a drive sprocket 104 fixedly attached to the shaft of drive roller 17. A tension arm 106 pivoted about point 108 with tension sprocket 110 and tension cylinder 112 is provided to maintain the tension in chain member 80 in the same manner as set forth above with regard to tension arm 48. While the above description refers to one preferred means of driving drive roller 17, it should be appreciated by one skilled in the art that any number of means of driving roller 17 could be utilized, including a drive not connected in any way to drive roll 16, a similar drive arrangement without a clutch unit, or any other driving arrangement that would be apparent to one skilled in the art.

Referring to FIG. 1, mounted on the frame are core guides 114 for maintaining the core of material roll 22 aligned during winding. Also illustrated in FIG. 1 is a lateral movement device generally illustrated at 116 which allows the entire winding unit to be moved laterally to maintain alignment with the device supplying the material to be wound. This may be accomplished by a cylinder 118 and bearing arrangements 120 as is well known in the art.

Figure 2A:
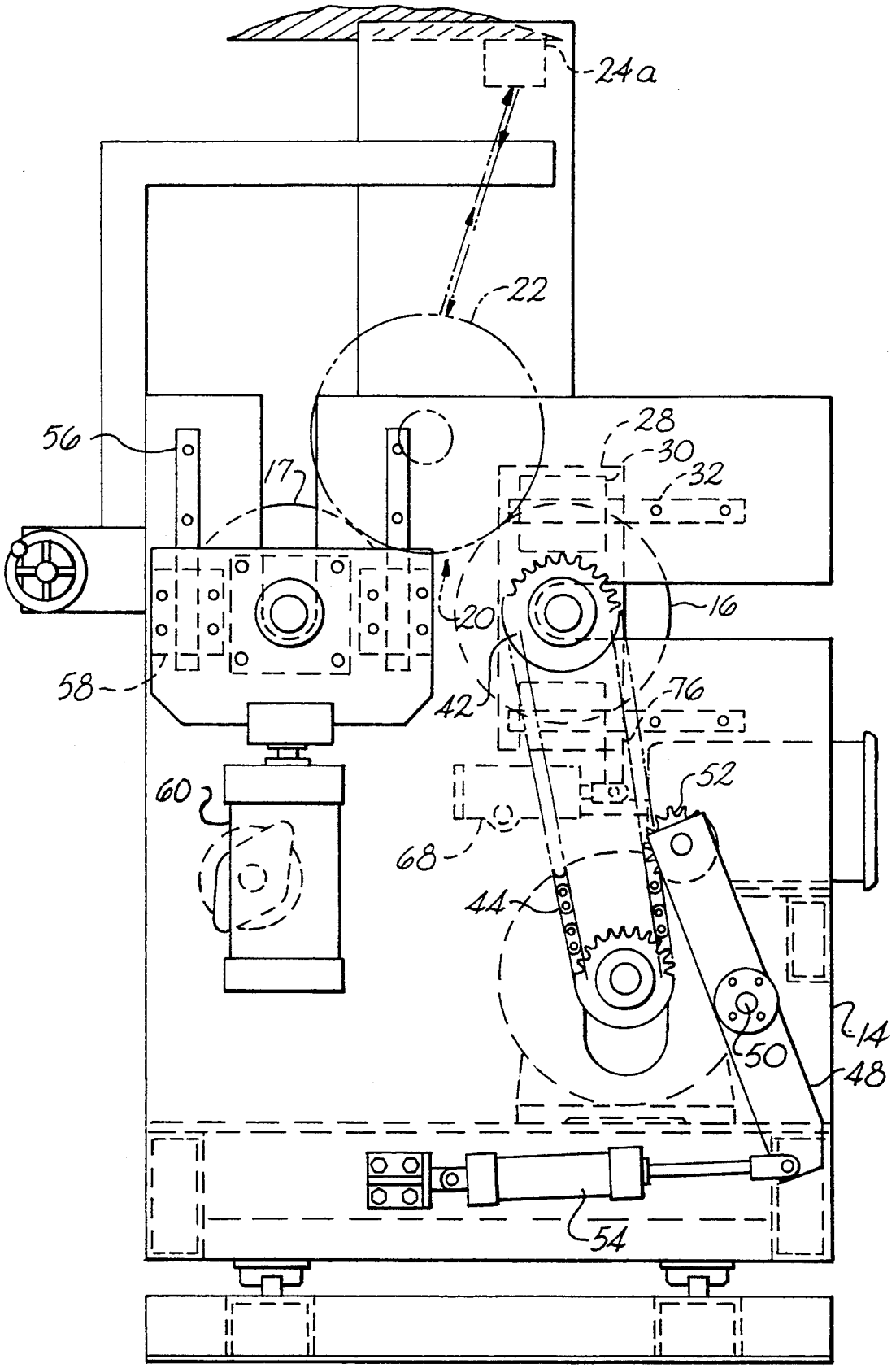
Figure 5:
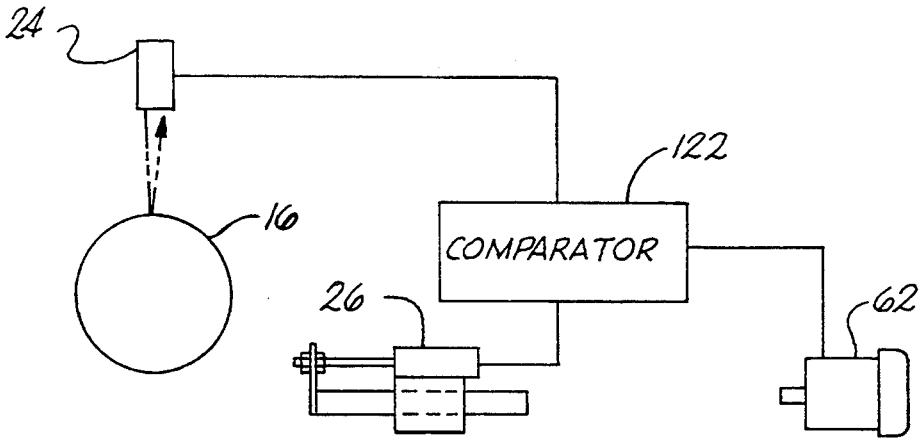
FIG. 5 is a schematic view illustrating an embodiment of a control system for use with the present invention.

Referring to FIGS. 1, 4, and 5, a preferred control mechanism for the present invention will be described. A proximity sensor 24 is arranged above material roll 22 and adapted to determine the distance between the outer diameter of roll 22 and sensor 24 whereupon it can detect the change in diameter of material roll 22. Sensor 24 may be an ultrasonic sensor, a photoelectric sensor, a laser sensor, or any other known sensor as would be apparent to one skilled in the art. Sensor 24 may be mounted at a small angle to the vertical above the material roll to compensate for changes in roll position as the drive roller 16 moves away as illustrated by sensor 24*a* in FIG. 2*a*. One example of a suitable proximity sensor would be an ULTRA-BEAM Ultrasonic Sensor, Model SUA925QD, as marketed by Banner Engineering Corporation of Minneapolis, Minn.

A roll position sensor 26 as illustrated in FIG. 4 is adapted to monitor the linear position of movable roll 16 as it is moved along its bearing tract. In a preferred embodiment, position sensor 26 may be a linear potentiometer, but it could also be any of the number of known devices that will provide monitoring of the position of drive roller 16 relative to a given position. An example of a suitable position sensor would be a LONGFELLOW Linear Motion Position Transducer as marketed by Talley Industries of Wayland, Mass.

A comparator 122 is provided which receives input from proximity sensor 24 and position sensor 26. Comparator 122 is established or programmed such that for any particular roll diameter, a desired linear position of drive roller 16 is defined. Comparator 122 compares the signal from position sensor 26 to a predetermined value for the signal received from proximity sensor 24 and signals motor 62 to increase or decrease responsive thereto to move drive roller 16 to the predetermined position for the particular roll diameter. Comparator 122 is established such that as drive roller 16 moves linearly, the area of contact between drive rollers 16 and 17 and material roll 22 will remain approximately the same to provide a uniform drive on roll 22 as its diameter increases. It should be appreciated by those skilled in the art that comparator 122 may be any type of known comparator such as, for example, a microcomputer.

It should be appreciated by those skilled in the art that the particular mechanical or electrical means utilized to accomplish the present invention are by way of example only. In addition, the predetermined value can easily be mathematically calculated, since the range of potential linear movement of the roller 16 will be known, as will the range of the roll diameter, the desired result being to have the tangent lines or contact points on the drive rollers against the roll of material remain in substantially the same area over the range of growth in diameter of the roll.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to be limitative of the invention so further described in such appended claims.

What is claimed is:

1. A surface drive winding apparatus for winding a material into a roll, said surface drive winding apparatus comprising:

a) a frame;

b) at least a pair of drive rollers supported on said frame having respective axes in substantially parallel orientation and forming a material roll receiving area therebetween for supporting and driving material roll for winding, one of said drive rollers being linearly stationary on said frame and the other of said drive rollers being linearly movable from an initial position in a direction essentially perpendicular to said axes and relative to said frame away from the other said stationary drive roller as said material roll grows in diameter;

c) a stationery proximity sensing device disposed above said material roll receiving area at a position displaced from a vertical plane through the longitudinal centerline of said material roll when said movable roller is at said initial position for sensing the approximate diameter of said material roll, the position of said proximity sensing device being such that said vertical plane moves toward said proximity sensing device as said material roll grows in diameter during winding;

d) a linear position sensor operably disposed relative to said movable drive roller and said frame to measure the linear displacement of said movable drive roller relative to said frame;

e) a controller in communication with said proximity sensing device and said linear position sensor, said controller configured to compare the linear position of said movable roller to a predetermined desired linear position corresponding to the measured approximate material roll diameter;

(f) a driving device in communication with said controller and configured to linearly move only said moveable drive roller to said predetermined desired linear position responsive to the approximate diameter of the material roll sensed by said proximity sensing device so that said movable drive roller will be moved relative to said stationary drive roller responsive to the measured changes in the diameter of the material roll as it is wound.

2. A surface drive winding apparatus as in claim 1, wherein said linearly movable drive roller is supported for movement in a linear bearing arrangement.

3. A surface drive winding apparatus as in claim 1, wherein said linear position sensor includes means for determining the position of said movable drive roller anywhere within its total linear range of movement.

4. A surface drive winding apparatus as in claim 3, wherein said linear position sensor includes a potentiometer generating a signal corresponding to the position of said movable drive roller.

5. A surface drive winding apparatus as in claim 1, wherein said proximity sensing device includes an ultrasonic sensor.

6. A surface drive winding apparatus as in claim 5, wherein said ultrasonic sensor is positioned above the roll of material.

7. A surface drive winding apparatus as in claim 6, wherein said sensor is mounted at an angle with respect to an axis extending perpendicular to the longitudinal axis of the roll of material to compensate for movement of the material roll when the drive roller is moved.

8. A surface drive winding apparatus as in claim 1, wherein said proximity sensing device includes a photoelectric sensor.

9. A surface drive winding apparatus as in claim 1, wherein said proximity sensing device includes a laser sensor.

10. A surface drive winding apparatus as in claim 1, wherein said movable drive roller is moved proportionally to the measured change in diameter of the material roll so that the position of the contact areas between the driving rollers and the material roll will remain substantially unchanged as the material roll is wound.

11. A surface drive winding apparatus for winding a material into a roll, said surface drive winding apparatus comprising:

a) a stationary frame;

b) at least a pair of drive rollers supported on said frame having respective axes in substantially parallel orientation and arranged so as to receive and drive a roll of material to be wound in the nip between the rollers, one of said drive rollers being linearly stationary relative said frame and the other of said drive rollers being mounted for linear movement from an initial position in a direction essentially perpendicular to said axes and relative to said frame away from said stationary roller as said material roll grows in diameter, and further comprising means for moving said movable drive roller;

c) a stationary proximity sensor disposed stationary above the nip between said drive rollers at a position displaced from a vertical plane through the longitudinal centerline of the nip between said drive rollers when said movable roller is at said initial position for sensing the approximate diameter of the material roll being wound as the material roll grows in diameter, the position of said proximity sensor relative to said drive rollers being such that a vertical plane through the longitudinal centerline of the material roll moves towards said proximity sensor during the winding process;

d) a position sensor operably disposed for sensing the linear position of said linearly movable drive roller relative to said frame;

e) a comparator in communication with said position sensor for comparing a signal indicative of the linear position of the movable drive roller to a predetermined desired value corresponding to the sensed material roll diameter, and providing a signal to said means for moving said movable drive roller to activate movement of said movable drive roller to said predetermined desired position so that the movable drive roller is moved proportionally to the sensed change in diameter of the material roll.

12. A surface drive winding apparatus as in claim 13, wherein the predetermined value is determined so that the position of the contact areas between said drive rollers and the material roll will remain substantially unchanged as the material roll is wound and the movable drive roller is moved.

13. A surface drive winding apparatus as in claim 11, wherein said proximity sensor is an ultrasonic sensor.

14. A surface drive winding apparatus as in claim 11, wherein said position sensor is a linear potentiometer.

* * * * *

UNITED STATES PATENT AND TRADEMARK OFFICE

CERTIFICATE OF CORRECTION

PATENT NO. : 5,441,213
DATED : August 15, 1995
INVENTOR(S) : Graham

It is certified that error appears in the above-indentified patent and that said Letters Patent is hereby corrected as shown below:

In the Abstract:

In line 8, after the word "sensing", please insert the word --device--.

In Column 2, line 10, after the word "wound", please add --and is disposed--; and in line 45, please delete the letter "s" from the word "alternates".

In the Claims:

Col. 6, claim 1, line 9, please insert the word --a-- between the words "driving" and "material"; and

Column 8:

in Claim 12, line 1, please delete "13" and substitute therefor --11--.

Signed and Sealed this

Fifth Day of December, 1995

*Attest:*

*Attesting Officer*

Bruce Lehman

BRUCE LEHMAN

*Commissioner of Patents and Trademarks*